US011952850B2

(12) United States Patent
Weston Zanelli et al.

(10) Patent No.: US 11,952,850 B2
(45) Date of Patent: Apr. 9, 2024

(54) UPPER HEAD ASSEMBLY FOR A CORE BARREL

(71) Applicant: BOYLES BROS DIAMANTINA S.A., Lima (DE)

(72) Inventors: Guillermo Ricardo Weston Zanelli, Lima (DE); Jorge Alonso Fernandez Gonzales, Lima (DE); Renzo Ronald Matias Caytuero, Lima (DE); Alex Ramiro Maguina Trujillo, Lima (DE)

(73) Assignee: BOYLES BROS DIAMANTINA S.A., Lima (PE)

( * ) Notice: Subject to any disclaimer, the term of this patent is extended or adjusted under 35 U.S.C. 154(b) by 175 days.

(21) Appl. No.: 17/428,092

(22) PCT Filed: Feb. 21, 2019

(86) PCT No.: PCT/PE2019/000004

§ 371 (c)(1),
(2) Date: Aug. 3, 2021

(87) PCT Pub. No.: WO2020/162767

PCT Pub. Date: Aug. 13, 2020

(65) Prior Publication Data

US 2022/0120152 A1 Apr. 21, 2022

(30) Foreign Application Priority Data

Feb. 4, 2019 (PE) ..... 000338-2019/DIN

(51) Int. Cl.
*E21B 25/02* (2006.01)
*E21B 23/00* (2006.01)

(52) U.S. Cl.
CPC ..... *E21B 25/02* (2013.01); *E21B 23/00* (2013.01)

(58) Field of Classification Search
CPC ..... E21B 25/00; E21B 25/04; E21B 25/10; E21B 25/02; E21B 25/06
See application file for complete search history.

(56) References Cited

U.S. PATENT DOCUMENTS 3,103,981 A 9/1963 Harper
3,126,064 A * 3/1964 Miller ..... E21B 25/02 175/246

(Continued)

FOREIGN PATENT DOCUMENTS

GB 2364341 A 1/2002

OTHER PUBLICATIONS

International Search Report and Written Opinion, PCT/PE2019/000004, dated Oct. 17, 2019.

*Primary Examiner* — Robert E Fuller
(74) *Attorney, Agent, or Firm* — Dickinson Wright PLLC

(57) ABSTRACT

The upper head assembly includes a main body, a retractable body, a support element and a rear element. A fluid control means is provided for increasing the passage of fluid during the descent into the well are disposed on the main body and comprise a closure/opening body that selectively permits fluid to pass through a bypass chamber inside the main body, in a working position, or through an area of rapid descent that facilitates the passage by following a path, during descent. The fluid bypass chamber is formed by a central chamber with inlet ports and outlet ports that allow a connection of fluid between the central chamber and the outside of the main body. The closure/opening body blocks the flow through the area of rapid descent when the working position is reached.

10 Claims, 21 Drawing Sheets

(56) References Cited

U.S. PATENT DOCUMENTS

| | | | | |
|---|---|---|---|---|
| 4,800,969 | A | 1/1989 | Thompson | |
| 5,934,393 | A | 8/1999 | Marshall | |
| 6,029,758 | A | 2/2000 | Novacovicci et al. | |
| 6,644,424 | B1 * | 11/2003 | Fanuel | E21B 25/02 175/252 |
| 8,770,322 | B2 | 7/2014 | Drenth et al. | |
| 9,359,847 | B2 | 6/2016 | Drenth | |
| 2011/0079436 | A1 * | 4/2011 | Drenth | E21B 25/02 175/58 |
| 2011/0083901 | A1 | 4/2011 | Drenth | |
| 2014/0353044 | A1 | 12/2014 | Lambert et al. | |

* cited by examiner

UPPER HEAD ASSEMBLY FOR A CORE BARREL

CROSS-REFERENCE TO RELATED APPLICATIONS

This application claims priority to PCT Application No. PCT/PE2019/000004, filed on Feb. 21, 2019 entitled "UPPER HEAD ASSEMBLY FOR A CORE BARREL" and Peru Application No. 000338-2019/DIN filed on Feb. 4, 2019 entitled "UPPER HEAD ASSEMBLY FOR A CORE BARREL."

FIELD

The present disclosure can be included in the technical field of drilling, in particular, of drilling to extract a core sample or undisturbed sample from geological or man-made formations by means of a core barrel. More specifically, the object of the disclosure relates to an upper head assembly of a core barrel.

BACKGROUND

The core barrel system uses an inner tube assembly that is inserted into a drilling pipe assembly. The inner tube assembly is composed of a tube (hereinafter referred to as the "inner tube") that receives the sample or core sample and an inner tube head assembly.

The drilling pipe assembly at its lower end is coupled to the outer tube assembly that is generally formed by a locking coupling, an adapter coupler, an outer tube, an arrival ring arranged between the end part of the adapter coupler and the initial part of the outer tube, a reamer, an inner tube stabilizer and a drill bit.

The arrival or working position of the inner tube assembly is determined when the arrival ring of the outer tube assembly contacts the support ring of the inner tube head assembly.

One of the problems encountered in this activity is the lowering time of the inner tube assembly to the arrival position due to the fact that the drilling pipe assembly contains fluid and the current solutions of inner tube assemblies and/or their components generate resistance to the fluid flow, increasing the lowering time.

By means of U.S. Pat. No. 5,934,393, it is known an inner tube assembly that includes a body of latches which is formed by two parts, each of which defines a part of a fluid bypass channel, which is formed by at least one inlet port, one chamber, and at least one outlet port. Inside the chamber of the fluid bypass channel, a ball valve, a bushing through which the ball valve can be forced by fluid pressure action and a threaded annular seat on which a valve spring sits are arranged. The fluid bypass channel allows to bypass fluid flow that is severely or completely restricted when the support ring of the inner tube assembly contacts the arrival ring of the outer tube assembly. The diameter of the ball valve and the minimum inside diameter of the bushing through which the ball valve must pass are of similar values. For example, a minimum inside diameter of the bushing of 0.850" and a ball valve diameter of 0.870" are mentioned, such arrangement being used as an indicator of arrival of the inner tube assembly, since fluid pressure will be needed to force the ball valve through the bushing. The ball valve, during the lowering of the inner tube assembly, can move axially within the chamber of the fluid bypass channel in such a way as to allow fluid passage through the outlet port, through the bushing and finally through the input port. According to this arrangement of components, the flow and hence the lowering time is dependent on the minimum inside diameter of the bushing.

A latch body for use in drilling head assembly is known from patent document U.S. Pat. No. 8,770,322. The drilling head assembly may include a fluid control subassembly, a check valve component, and/or a hollow spindle, where the latch body may define a central hole that extends along its longitudinal length through the proximal and distal end portions of the latch body. The distal portion of the latch body may include a port section defining a chamber with fluid connection to the central hole of the latch body. The chamber of the port section of the latch body may be configured to at least partially receive the check valve component of the drilling head assembly. The hollow spindle of the fluid control subassembly is operatively attached and in fluid connection with the chamber of the port section of the latch body. The proximal portion of the latch body may be configured to receive the fluid control subassembly which may have a common longitudinal axis with the latch body. The fluid control subassembly may include a valve component configured to move relative to the common longitudinal axis. The fluid control subassembly may further include a spring configured to press the valve component. Additionally, the fluid control subassembly can include a bushing that sits on the proximal and of the latch body and that can be configured to restrict fluid flow and create a pressure change.

The function of the body of latch described in patent document U.S. Pat. No. 8,770,322 is to allow a fluid connection through the central hole of the body of latch to increase the speed of lowering within a pipe assembly; however, the fluid control subassembly by also including a bushing, limits the flow since this will be dependent on the minimum inside diameter of the bushing regardless of the diameter or dimension of the fluid passage of the latch body being greater.

It is known from patent document U.S. Pat. No. 9,359,847 to a high productivity core drilling system comprising a drilling pipe assembly, an inner tube assembly, an outer tube assembly and an extraction tool that is connected to the inner tube assembly through a cable to a winch. The inner tube assembly comprises a latching mechanism that can be configured to have no frictional contact with the inner surface of the tube assembly during the lowering of the inner tube assembly. The latching mechanism may be actuated by fluid pressure that is controlled by a fluid control valve that is comprised of a fluid control valve component and a valve ring. The fluid control valve component is operatively attached to the outer subassembly of the inner tube assembly by a pin. Even when the latching mechanism is configured so as not to hinder the lowering due to friction with the inner surface of the pipe assembly, the lowering time will still be determined mainly by the fluid flow through the inner tube assembly and this by containing a fluid control valve component and a valve ring, will create restriction to the fluid flow.

There is, therefore, a need to improve drilling coring systems where it is required to extract the unaltered sample and where the process is performed in an agile manner and without delays during the lowering to the bottom of the well as product of the pressure exerted by the fluids that intervene in it. This will become apparent from an upper head assembly of inner tube for taking of core sample that includes one or more fluid flow relief components for rapid core barrel head lowering.

SUMMARY

The disclosure in a general aspect refers to a system for extracting the sample by means of a core barrel which comprises an inner tube assembly that is fixed at one end to a cable for its lifting and released for its lowering, by action of gravity, within a drilling pipe assembly with a certain level of fluid, towards the bottom of the well and that receives the sample or core sample; an outer tube assembly disposed outside of the inner tube assembly. The inner tube assembly comprises an inner tube head assembly mounted on one end of the inner tube; said inner tube head assembly is divided into an upper inner tube head assembly and a lower inner tube head assembly comprising the upper inner tube head assembly fluid control means to allow increasing the fluid flow during the displacement of the inner tube assembly within the borehole, such that these means comprise at least one closing/opening body that selectively allows the fluid flow through the fluid bypass chamber or through the rapid lowering area defined by a main body, a support component and at least one rear component, the main body being able to have a lower body attached in whose case the main body is divided into two parts and the lower body replaces the function of the rear component and now the support component is the one that allows the greatest flow of water through fluid passage channels of the support component.

In accordance then with the present disclosure, there is provided in a first embodiment, an upper inner tube head assembly including a main body on which at least one valve component is mounted and in turn concentrically and externally to the valve component a retractable body is arranged on which, transversely, a valve actuator component is arranged which fixes the retractable body with the valve component, so as to allow the latter to move in the axial direction in both directions. Mounted on the main body is also a support component whose position is restricted in the axial direction by a rear component which is attached to the main body through a connector component of rear component. The main body has a fluid bypass chamber which is formed by a central chamber, at least one inlet port and at least one outlet port that allow a fluid connection between the central chamber and the exterior of the main body when the support component contacts an arrival ring of the outer tube assembly and in turn the valve component contacts the support component significantly or completely blocking flow through the space between the support component and the arrival ring and also between the support component and the valve component.

The main objective of the present disclosure is to increase the rate of lowering of the inner tube assembly, increasing the area of fluid passage through the upper inner tube head assembly by allowing the fluid flow through the bypass chamber of fluid and additionally and mainly by allowing the fluid flow through the rapid lowering area defined by the main body, the support component and at least one rear component when at least one valve component or opening/closing component is not in contact with the support component of the inner tube assembly and is distant a certain axial distance from it.

DESCRIPTION OF THE PREFERRED METHODS OF IMPLEMENTATION

The following figures are not to scale. The actual dimension for each of the components can vary according to the user's need. The most significant details of the device are highlighted, so that a person who does not have expertise in the technical field can clearly appreciate the concept. However, it should be understood that this disclosure is not limited to the specific components or systems described below, unless specifically indicated; therefore, they may vary. It should also be understood that the terminology used herein is for the purpose of describing aspects of the disclosure and not as a limitation thereof.

The following figures describe the disclosure in its preferred embodiments. A person skilled in the art will recognize that variations can be made to various aspects of the disclosure while maintaining the benefits of the present disclosure. For the aforementioned, the following description is provided to illustrate the various aspects of the present disclosure and not as a limitation thereof.

Figure 1A:
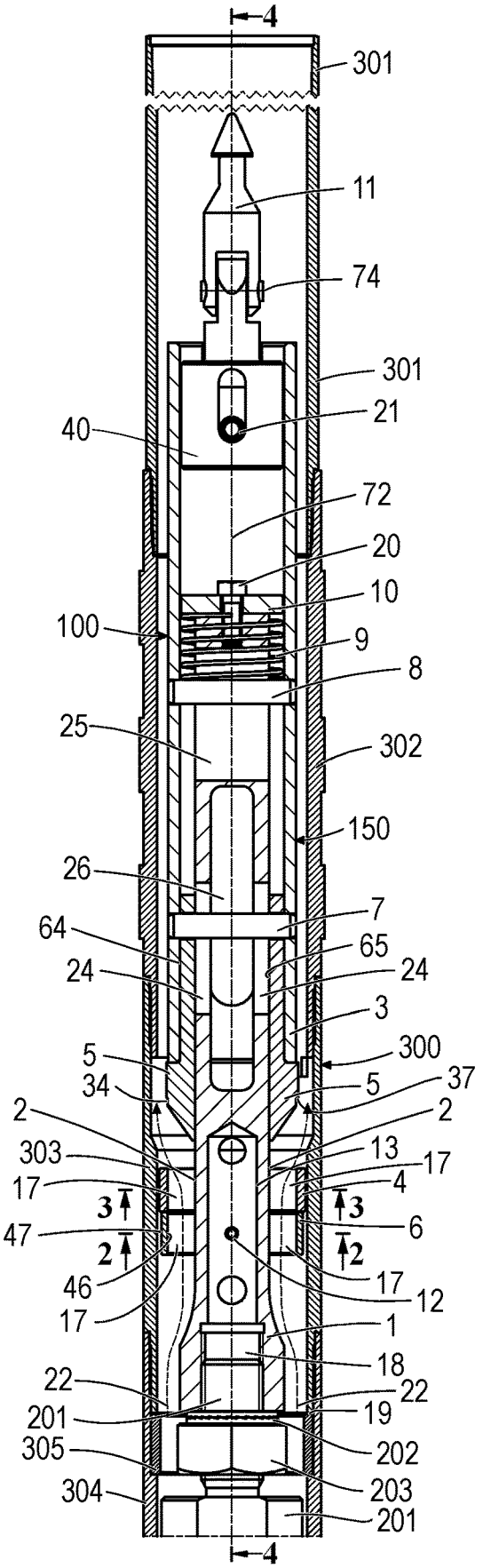
FIGS. 1A and 1B: Longitudinal section views arranged one after the other, where the axial section line 4-4 and the cross-section lines 2-2 and 3-3, of a core barrel coupled to a drilling pipe with an inner tube head assembly in the lowering position, according to a first embodiment of the disclosure.
Figure 1B:
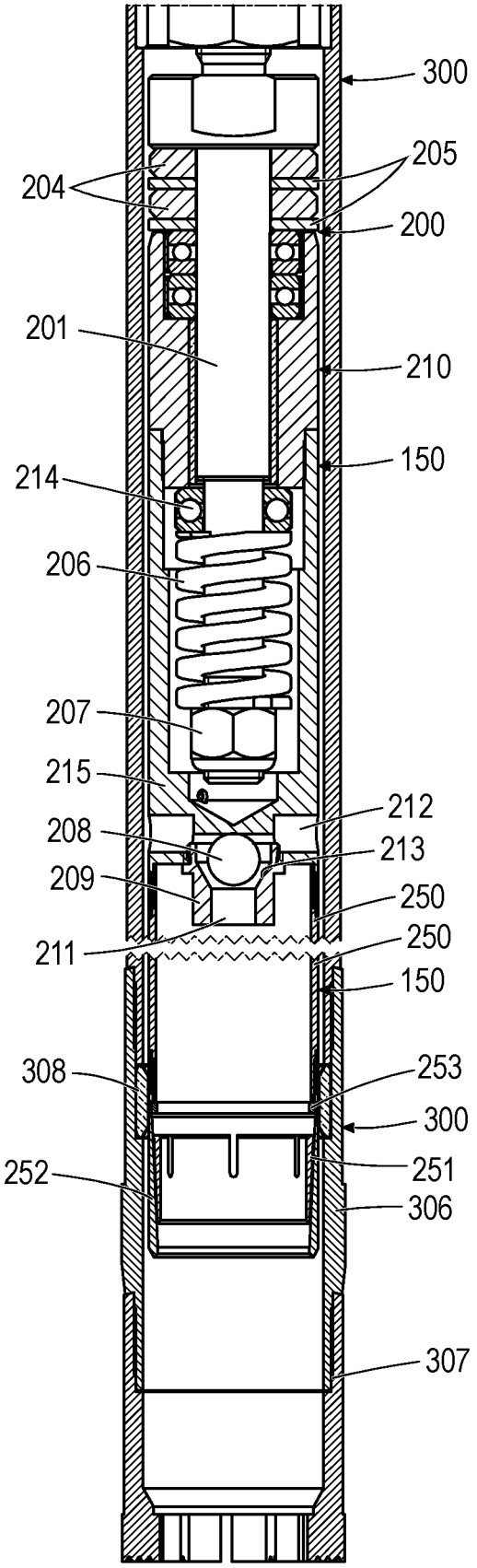
Figure 4:
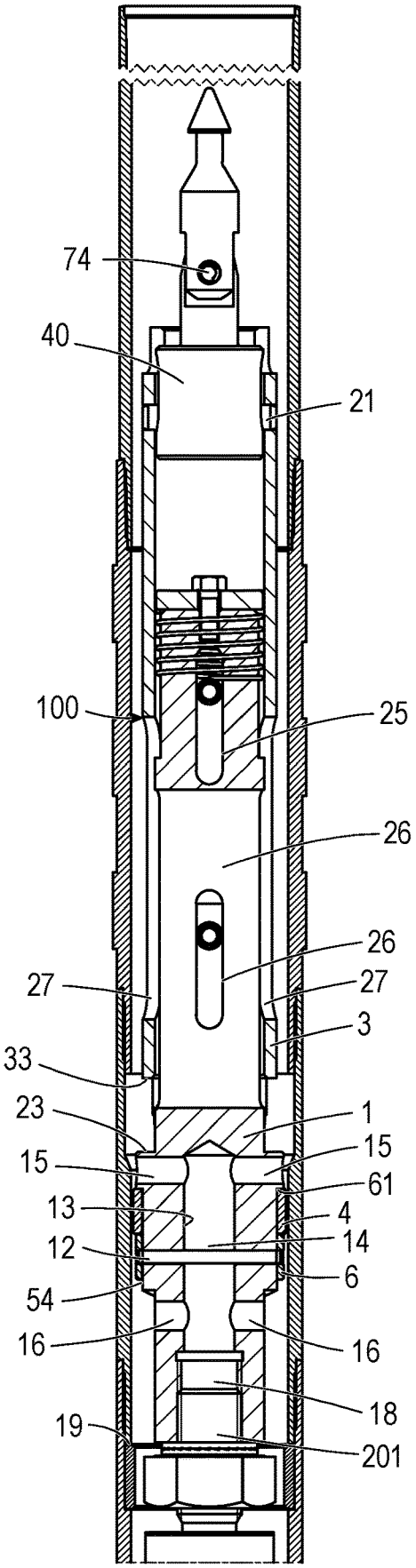
FIG. 4: Longitudinal section view through section line 4-4 of FIG. 1A, according to the first embodiment of the disclosure.

FIGS. 1A, 1B and 4 show, according to a first embodiment of the disclosure, in a longitudinal section view, a drilling pipe assembly 301 which at its lower end is coupled with an outer pipe assembly 300 which is formed by a locking coupling 302 connected at its upper end to the drilling pipe assembly 301 and at its lower end to an adapter coupler 303 which is connected at its lower end to an outer tube 304 which at its upper end, in addition to receiving the threaded end of the adapter coupler 303, also receives internally an arrival ring 305. A reamer 306 receives at its upper end the lower threaded end of the outer tube 304 and further also internally receives an inner tube stabilizer 308. The reamer 306 is intended to maintain a constant diameter slightly larger than the outside diameter of a drilling bit 307 coupled to the lower end of the reamer 306. Concentrically and within outer tube assembly 300 is an inner tube assembly 150, which is formed by an upper inner tube head assembly 100 and a lower inner tube head assembly 200, which are coupled to each other in a coupling area 18. Attached to the lower end of the lower inner tube head assembly 200 there is an inner tube 250 inside which the sample of the formation being drilled by the drilling bit 307 is accommodated. Attached to the end of the inner tube 250 is a sample fastener holder 252 which houses inside a sample fastener 251 whose function is to allow the sample to enter the formation being drilled and to firmly secure and break the sample when it is time to remove the inner tube assembly 150 by exerting an upward axial force through fishing coupling 11. The sample fastener 251 has a limit on axial displacement within the sample fastener holder 252 determined by a stop ring 253.

The lower inner tube head assembly 200 is composed of a shaft 201 on which are mounted a shut-off valve 204, a shut-off valve washer 205, a bearing assembly 210, an axial bearing 214 and a compression spring 206 and securing all the aforementioned components to the shaft 201 is an anti-rotation nut 207. Connected to the lower end of the bearing assembly 210 is an inner tube connector 215 which at its lower end is coupled with a check valve body 209 and which houses a check valve 208, which allows fluid connection in the direction from an inlet port 211 to an outlet port 212 and blocks fluid connection in the opposite direction when the check valve 208 contacts a check valve seat 213.

FIGS. 1A and 4 show the upper inner tube head assembly 100 during the lowering towards the working position, which is made up of a main body 1 on which at least one valve component 5 is mounted, which moves on a sliding surface 2 in the axial direction along an axial axis 72 and which is connected to a valve component connector 7 that allows transmitting the axial movement of a retractable body 3, which is located arranged concentrically to the main body 1.

Figure 2:
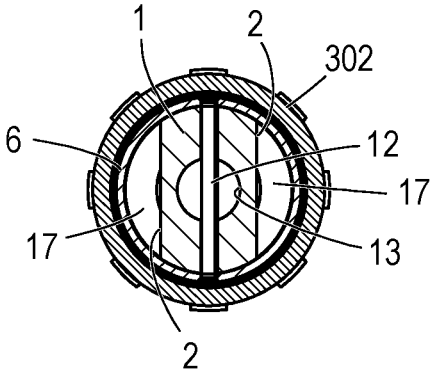
FIG. 2: Cross-sectional view through cutline 2-2 of the upper inner tube head assembly in the lowering position, according to the first embodiment of the disclosure.
Figure 3:
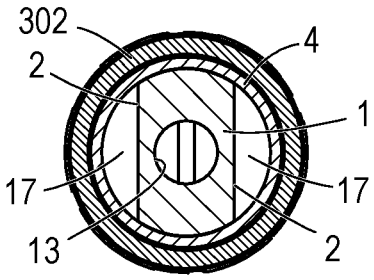
FIG. 3: Cross-sectional view through cutline 3-3 of the upper inner tube head assembly in the lowering position, according to the first embodiment of the disclosure.

It can be seen in FIGS. 1A, 2, 3 and 4 that a support component 4 is mounted on the main body 1, whose axial upward movement is restricted by a seat 61 and in the opposite direction there is a rear component 6 whose inner surface of rear component 46 cooperates with the outer surface 54, this rear component 6 is coupled to main body 1 through a rear ring connector 12, which in this embodiment is a spring pin, but can be any component such as to secure the position of the rear component 6 with respect to the main body 1. The outer surface of the rear component 47 is cylindrical in shape, such that it can pass through the interior of the arrival ring 305; however, it is evident that this form can vary without ceasing to fulfill its function. The main body 1, and more specifically the sliding surface 2, together with the support component 4 and the rear component 6 form a rapid lowering area 17 that allows the free fluid flow following the fluid and path line of fluid flow 22 during the lowering of the inner tube assembly 150. Those skilled in the art will appreciate that through the rapid lowering area 17 the flow will be greater than the flow through a fluid bypass chamber 13 arranged within the main body 1 and that communicates with the outer surface of the main body 1 in at least two different positions along the chamber, and will not have to make sudden changes of direction unlike the current solutions of inner tube assemblies and/or its components, where the greatest amount of fluid during the lowering must pass through the interior of a bushing or ring within a fluid bypass channel of a body of latches. In FIGS. 1A, 2 and 3 it is shown that the sliding surface 2 is flat; however, this surface can have any shape such that it allows the sliding of the at least one valve component 5, so that the rapid lowering area 17 may have a shape other than that shown in FIGS. 2 and 3; as will be detailed later with the description of FIGS. 24A to 24D.

FIGS. 1A, 1B, 4, 7 and 8 show the main body 1, which at its lower end has the coupling area 18 which allows the upper inner tube head assembly 100 to be joined with an upper end of the shaft 201 of the lower inner tube head assembly 200 by means of an adjustment component 203, which in this case is a nut and a locking component 202 which in this case is an anti-rotation type washer. Immediately superior to the coupling area 18 is the fluid bypass chamber 13 which has a central chamber 14, at least one inlet port 15 and one outlet port 16 which allow a fluid connection inside the main body 1 at both ends of the support component 4 and the rear component 6. Crossing the central chamber 14 transversely is a rear ring connector hole 32, whose function is to receive the rear ring connector 12. Transversely to the main body 1, there is a lower groove 24 which guides the movement of the valve component connector 7. Additionally, a latch mechanism housing 26 is traversing the main body 1, the geometry of which is mainly an elongated groove with the dimensions necessary to house a mechanism of latches which is not shown in the figures, since it is not essential to show the operation of the present disclosure. Finally, at the upper end of the main body 1 there is an upper groove 25 which guides the movement of a retractable body connector 8, which in cooperation with a preferred position component 9 and a stop 10 press the retractable body 3 and by hence the at least one valve component 5 through the valve component connector 7 to be in contact with the support component 4 when the inner tube assembly 150 has reached the working position. The stop 10 is coupled to the main body 1 through a stop connector 20, which in this embodiment is a hexagonal head bolt.

Figure 5A:
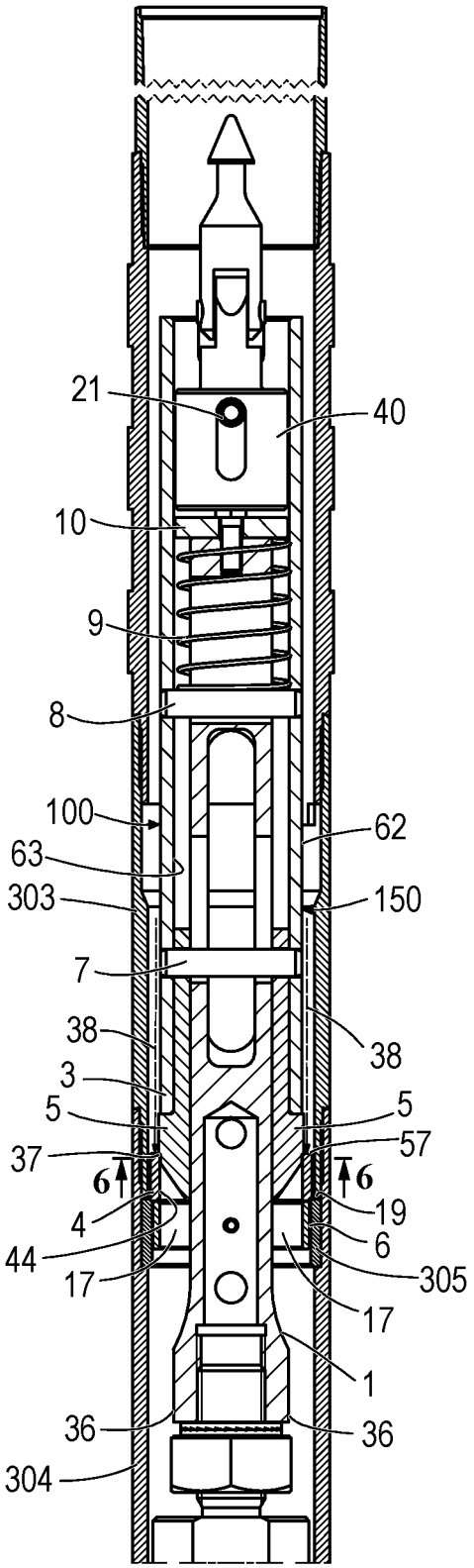
FIGS. 5A and 5B: Longitudinal section views arranged one after the other, with the cutlines and 6-6, of a core barrel coupled to a drilling pipe with an inner tube head assembly in the working position, according to the first embodiment of the disclosure.
Figure 6:
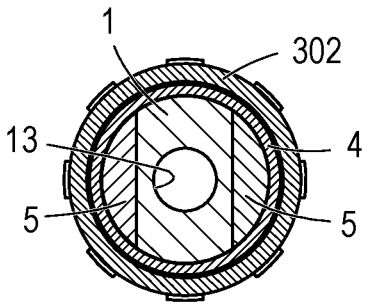
FIG. 6: Cross-sectional view through the 6-6 cutline of the upper inner tube head assembly in the working position, according to the first embodiment of the disclosure.
Figure 5B:
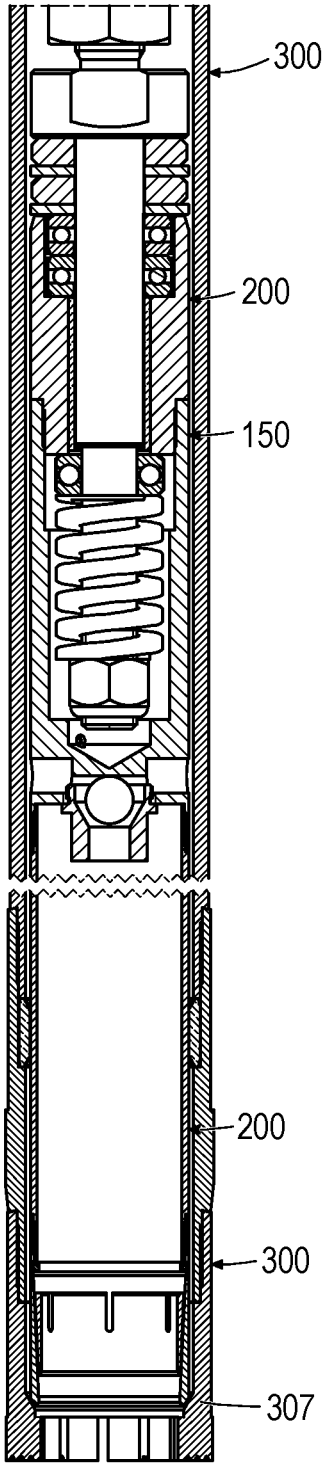
Figure 7:
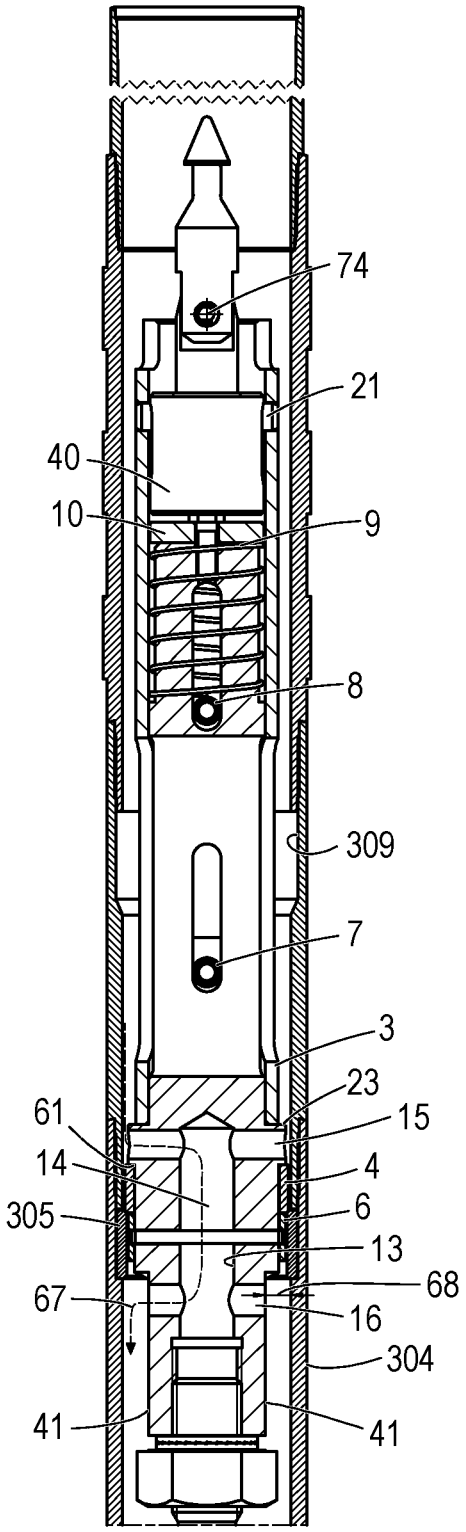
FIG. 7: Longitudinal section view through the core barrel, according to the first embodiment of the disclosure.
Figure 8:
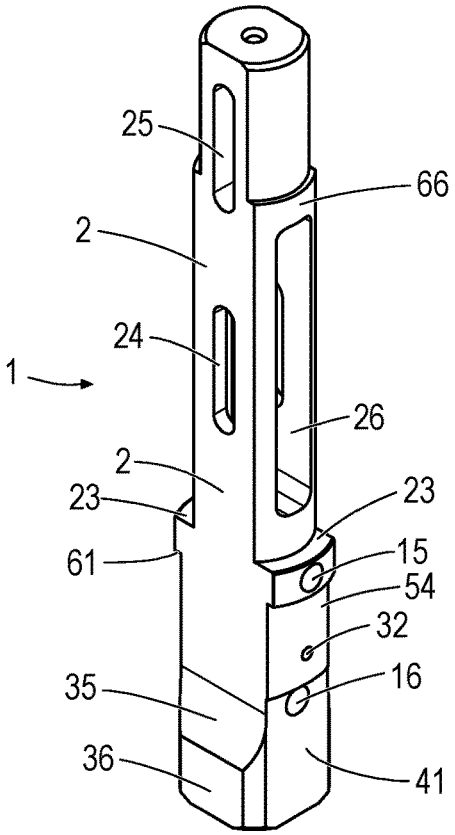
FIG. 8: Isometric view of the main body of the upper inner tube head assembly, according to the first embodiment of the disclosure.

In FIGS. 5A, 5B, 6 and 7 the inner tube assembly 150 is shown in the arrival or working position in which the support component 4 makes contact with the seating surface of an arrival ring 19. In that position, a valve seating surface 37 contacts a support component seat surface 57 blocking the flow through the rapid lowering area 17, as shown in interrupted fluid passage path 38 and consequently the flow is forced through the fluid bypass chamber 13, entering through inlet port 15, through central chamber 14 and finally exiting through outlet port 16 towards drilling bit 307 following the fluid bypass path 67. The axial displacement of the retractable body 3 is restricted when the latter makes contact with a seat of the retractable body 23 and this position is maintained by the action of the preferred position component 9 acting on the retractable body 3 through the retractable body connector 8. It should be noted that in this position the latch mechanism is in its latch seating position within a recess 309 in the upper end of the adapter coupler 303 in cooperation with the lower end of the padlocked coupler 302 as is well known in the art, avoiding the axial upward displacement of the inner tube assembly 150. In FIGS. 5A, 7 and 8, it can be seen that immediately following the sliding surface 2 there is a transition surface 35 that allows a progressive change to a recess 36 that allows to increase the fluid passage area in this area of the main body 1 during the lowering of the upper inner tube head assembly 100 by being separated from the inner surface of the outer tube 304. An outlet port surface 41 allows to have a greater distance from outlet port 68 in the arrival or working position.

Figure 9:
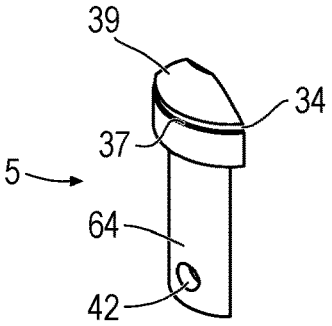
FIG. 9: Isometric view of the valve component of the upper inner tube head assembly, according to the first embodiment of the disclosure.

In FIGS. 5A and 9 the at least one valve component 5 is shown in greater detail, whose valve seating surface 37 closes the flow of the fluid when making contact with the support component seat surface 57. A valve guide surface 34 maintains the position of the at least one valve component 5 during the entry of this valve seating surface 37 into the inner surface of the support component 44. A fluid transition surface 39 allows directing the fluid gradually toward an outer surface of the retractable body 62. An outer surface of the valve component 64 works in conjunction with an inner surface of the retractable body 63 to allow the at least one valve component 5 to be accommodated within the retractable body 3. An inner surface of valve component 65 works in conjunction with the sliding surface 2 to allow relative movement of the at least one valve component 5 with respect to the main body 1. A connection hole 42 allows the connection component 7 to be partially accommodated.

Figure 10:
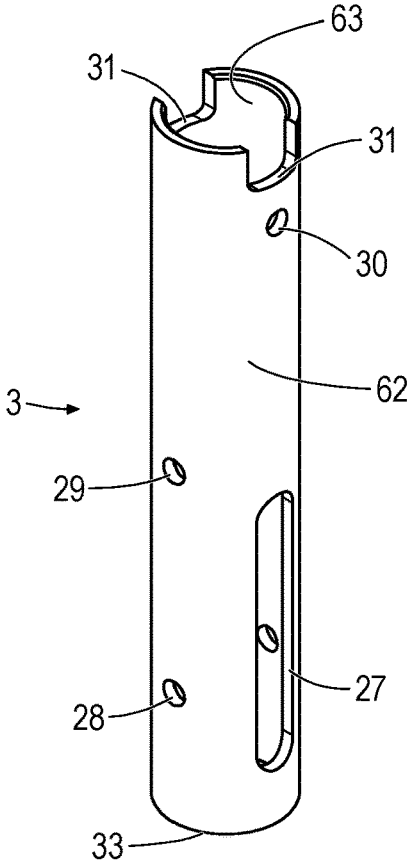
FIG. 10: Isometric view of the retractable body of the upper inner tube head assembly, according to the first embodiment of the disclosure.

FIG. 10 shows an isometric view of the retractable body 3, where the inner surface of the retractable body 63 works in cooperation with an outer displacement surface 66 of the main body 1 of FIG. 8, to allow the concentric movement of the retractable body 3 with respect to the main body 1. In this embodiment, the inner surface of the retractable body 63 is cylindrical; however, it can take a different shape such that in cooperation with the main body 1, it allows the relative displacement of the retractable body 3. The outer surface of the retractable body 62 allows directing the flow outside of the retractable body 3. In this figure, the outer surface of the retractable body 62 has a cylindrical shape; however, it is evident that there may be variants of this geometry. At its lower end, it has a stop surface 33 which, when in contact with the retractable body seat 23 of the main body 1, limits the axial displacement of the retractable body 3. Transversely to the entire retractable body 3 is a latch groove 27 through which the latches of the latch mechanism pass. Transversely to the entire retractable body 3, there is a valve component connector hole 28 through which the valve component connector 7 passes, and in the middle of the retractable body 3, transversely to it, there is a retractable body connector hole 29 through which the retractable body connector 8 passes. At the upper end of the retractable body 3, there is a fishing coupling connector hole 30 through which a fishing coupling connector 21 passes through which a fishing coupling base 40 can move axially and transmit the axial movement to the retractable body 3. Finally, there is a recess for fishing coupling pivoting 31 at the upper end of the retractable body 3, which allows the fishing coupling 11 to pivot around the axis of rotation 74 and can do so with a greater angle of rotation.

Figure 11:
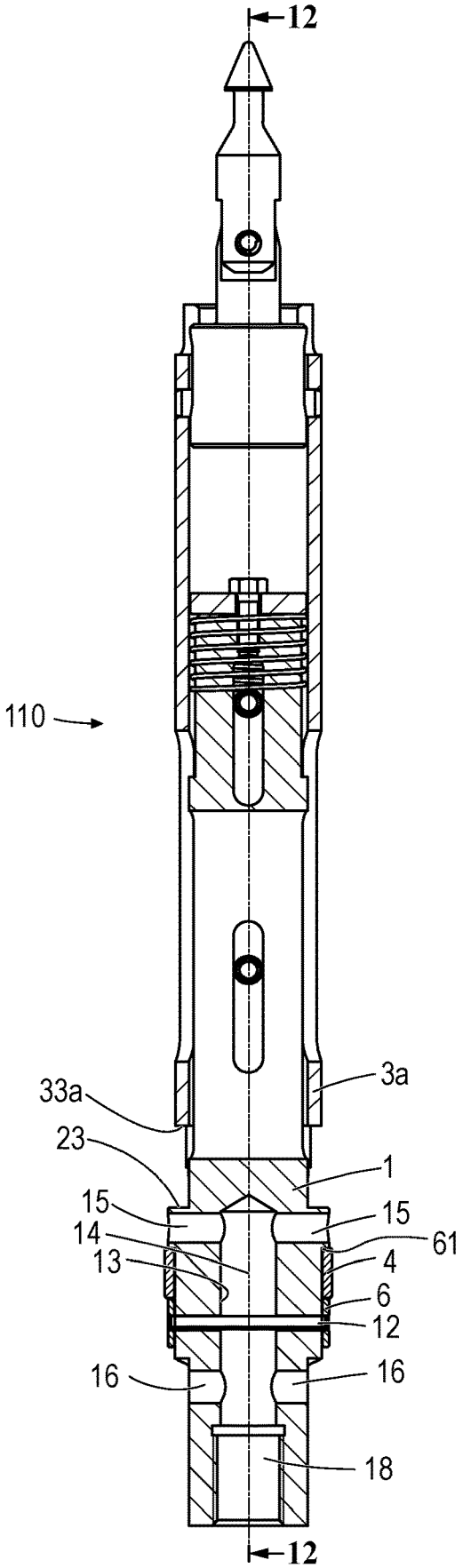
FIG. 11: Longitudinal section view showing an upper inner tube head assembly in the lowering position, according to a second embodiment of the disclosure.
Figure 12:
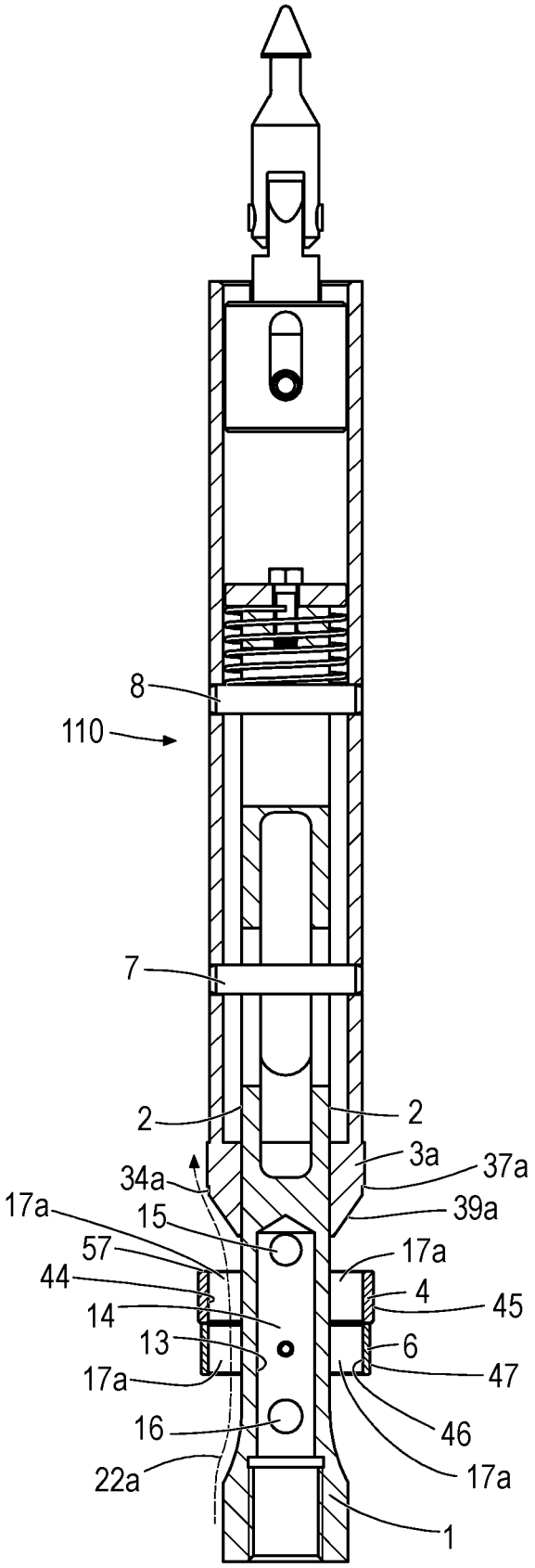
FIG. 12: Longitudinal section view through the cutline 12-12 of the upper inner tube head assembly in the lowering position, according to the second embodiment of the disclosure.
Figure 13:
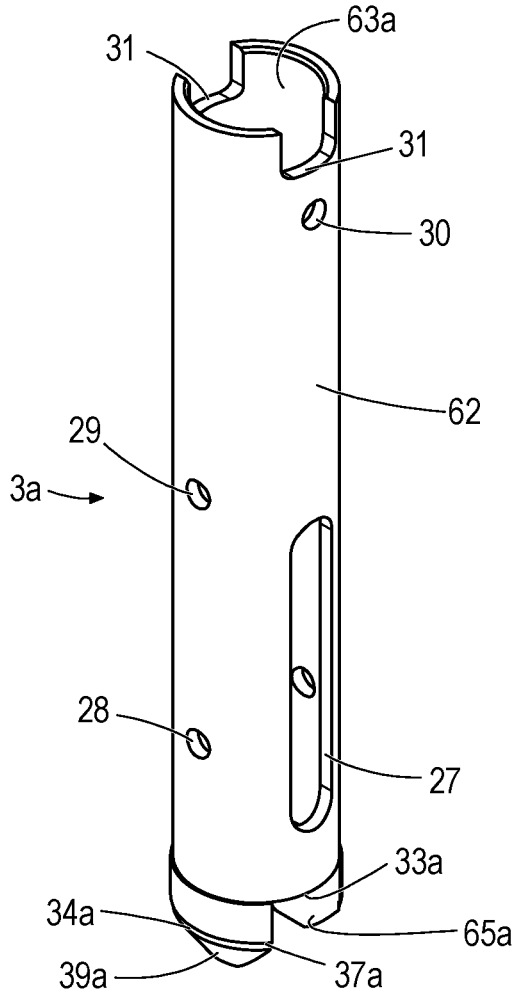
FIG. 13: Isometric view of the retractable body of the upper inner tube head assembly, according to the second embodiment of the disclosure.
Figure 14:
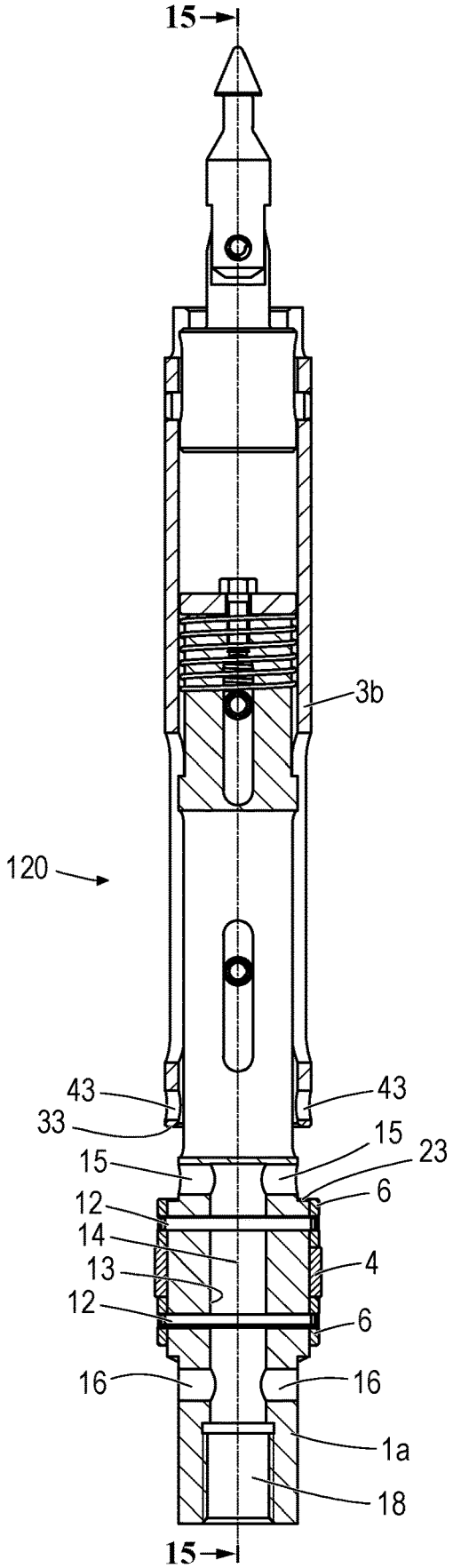
FIG. 14: Longitudinal section view where the axial cutline 15-15 of an upper inner tube head assembly in the lowering position is showed, according to a third embodiment of the disclosure.
Figure 15:
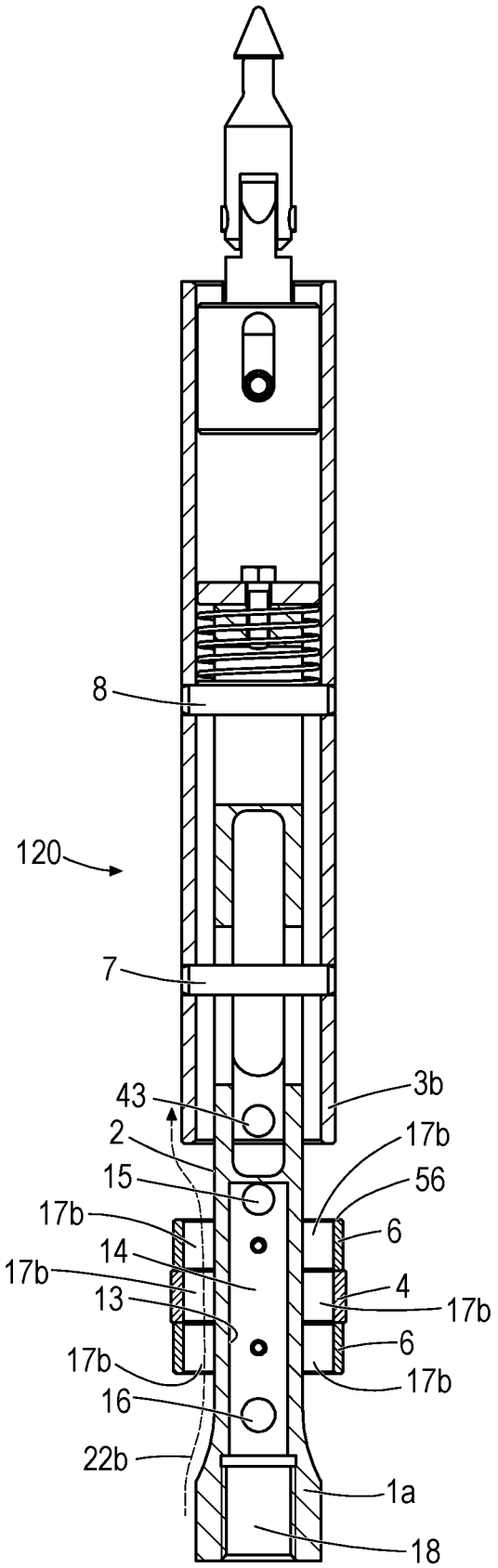
FIG. 15: Longitudinal section view through the cutline 15-15 of the upper inner tube head assembly in the lowering position, according to the third embodiment of the disclosure.
Figure 16:
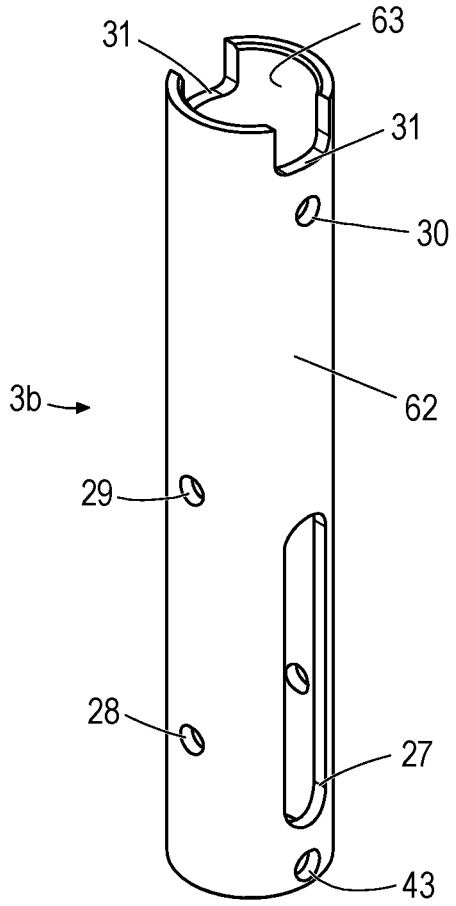
FIG. 16: Isometric view of the retractable body of the upper inner tube head assembly, according to the third embodiment of the disclosure.
Figure 17:
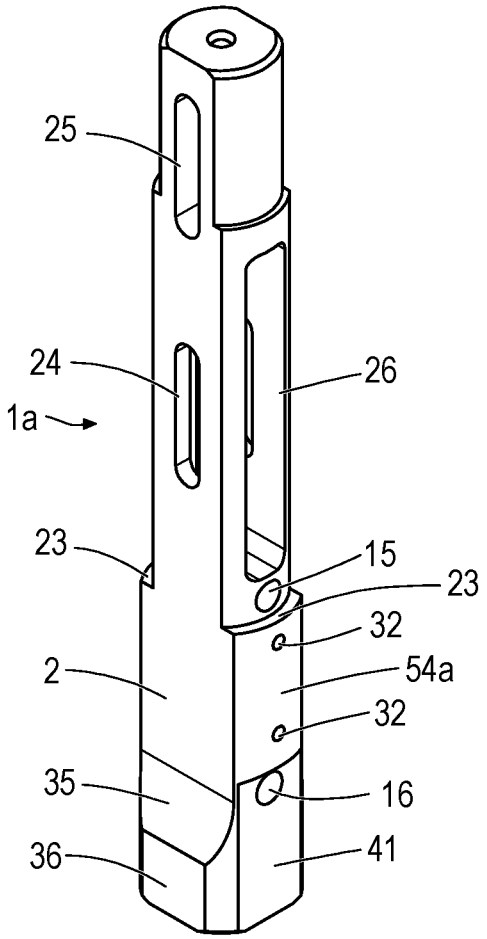
FIG. 17: Isometric view of the main body of the upper inner tube head assembly, according to the third embodiment of the disclosure.
Figure 18:
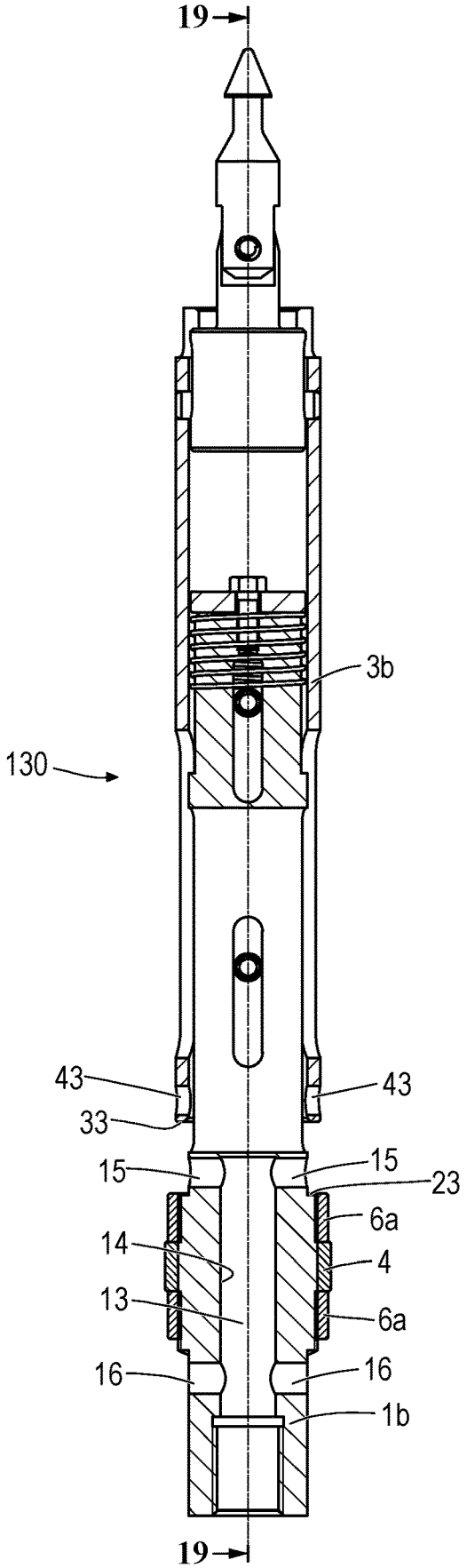
FIG. 18: Longitudinal section view where the axial cutline 19-19 of an upper inner tube head assembly is showed in the lowering position, according to a fourth embodiment of the disclosure.
Figure 19:
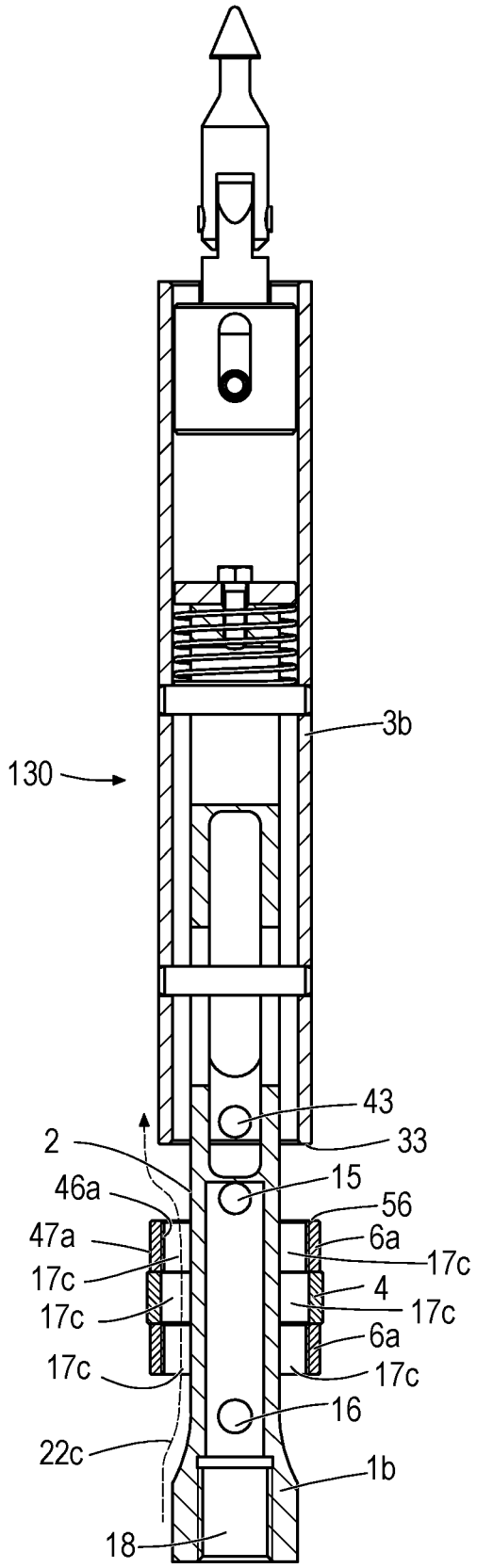
FIG. 19: Longitudinal section view through the cutline 19-19 of the upper assembly of the inner tube head in the lowering position, according to the fourth embodiment of the disclosure.
Figure 20:
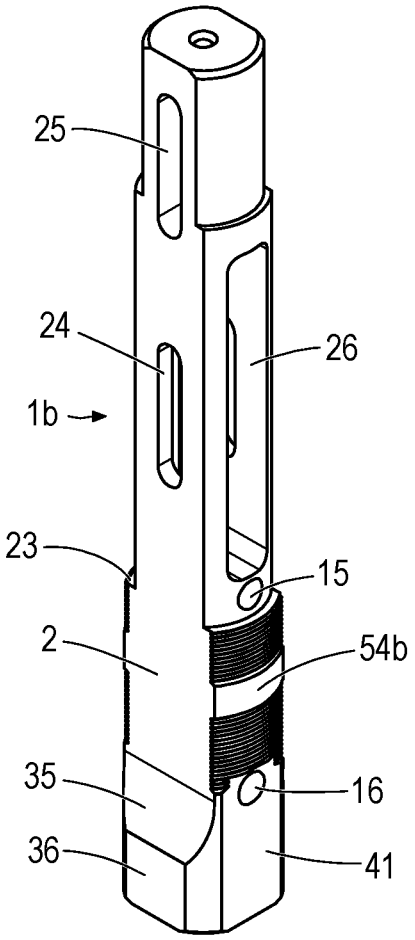
FIG. 20: Isometric view of the main body of the upper inner tube head assembly, according to the fourth embodiment of the disclosure.

FIGS. 11, 12 and 13 show a second embodiment of an upper inner tube head assembly 110 in which a retractable body 3*a* has been modified in such a way as to incorporate certain components of the geometry of the at least such a valve component 5, a fluid transition surface 39*a*, a valve guide surface 34*a*, a valve seating surface 37*a* and an inner valve component surface 65*a*. The axial displacement of the retractable body 3*a* in the direction towards the retractable body seat 23 is limited by a stop surface 33*a* that contacts the retractable body seat 23. A rapid lowering area 17*a* is then defined by the sliding surface 2, the support component 4 and the rear component 6. The fluid in this second embodiment will follow the fluid passage path 22*a*.

FIG. 13 shows an isometric view of the retractable body 3*a*, whose inner surface of the retractable body 3*a* is cylindrical, but then there is an inner surface of the valve component 65*a* that allows the retractable body 3*a* to move relative to the sliding surface 2.

FIGS. 14 to 17 show a third embodiment of an upper inner tube head assembly 120, where the main body is additionally mounted by a second rear component 6 on the support component 4, whereby an outer surface 54*a* of the main body has two rear ring connector holes 32, axially spaced in such a way as to allow the two rear components 6 to be positioned and intermediate them, the support component 4. The retractable body 3*b* has at its lower end at least one inlet port of the retractable body 43 that, when the stop surface 33 makes contact with the retractable body seat 23, allows a fluid connection from the outside of the retractable body 3*b* to the fluid bypass chamber 13 through the inlet port 15. A rapid lowering area 17*b* is then defined by the sliding surface 2, rear component 6, support component 4 and rear components 6. The fluid in this third embodiment will follow the fluid passage path 22*b*.

FIGS. 18 to 21 show a fourth embodiment of an upper inner tube head assembly 130, where the main body 1*b* has two rear components 6*a* mounted in a threaded manner and intermediate to these is the support component 4. The main body 1*b* has the outer surface 54*b* partially threaded at both ends, where the non-threaded intermediate part will serve to receive the support component 4. The rapid lowering area 17*c* is then defined by the sliding surface 2, the rear component 6*a*, support component 4 and rear component 6*a*. The fluid in this second embodiment will follow the fluid passage path 22*c*.

Figure 21:
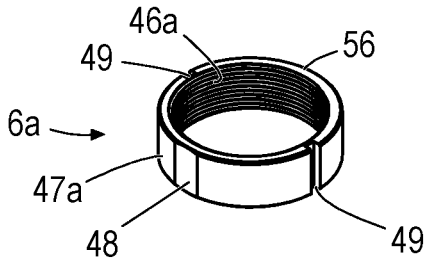
FIG. 21: Isometric view of the rear component of the upper inner tube head assembly, according to the fourth embodiment of the disclosure.

FIG. 21 shows an isometric view of the rear component 6*a*, where an inner surface of the rear component 46*a* is threaded and an outer surface of the rear component 47*a* is cylindrical, having at least one recess surface 48 and/or a groove 49 that allows the rear component 6*a* to be fitted securely to the main body 1*b*. In this embodiment, the axial displacement of the retractable body 3*b* is limited by a rear component seating surface 56 which upon contacting the stop surface 33 closes the fluid connection through the rapid lowering area 17*c* and the fluid is forced through the fluid bypass chamber 13.

FIGS. 22 to 24A and 25 to 28 show a fifth embodiment of an upper inner tube head assembly 140, where a main body 1*c* has a primarily cylindrical sliding surface 2*a* cooperating with a lower retractable body surface 63*a*, so that the retractable body 3*c* is axially displaced relative to a main body 1*c*. Mounted on an outer surface 54*c* is a support component 4*a* whose inner support component surface 44 and outer support component surface 45 are cylindrical and whose upper axial position is defined by a support component seat 61*a*. A lower body 50 is connected to the main body 1*c* through a coupling area 60 cooperating with a lower main body coupling area 55, in such a way that the support component 4*a* is completely restricted from movement.

Figure 22:
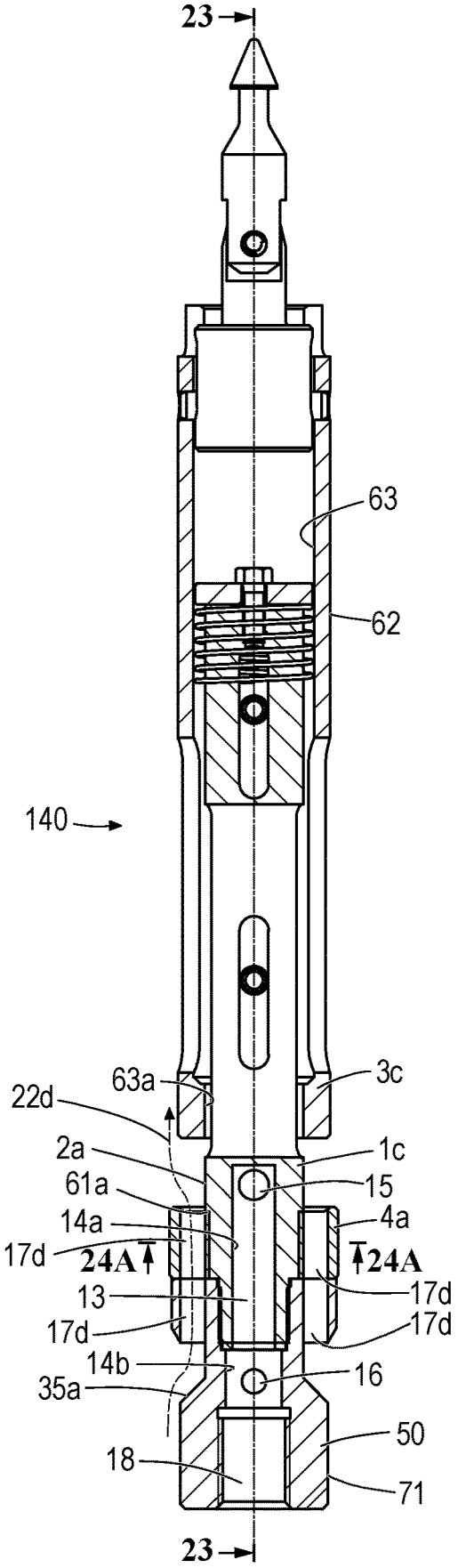
FIG. 22: Longitudinal section view where the axial cutline 23-23 and the cross-cutline 24A-24A of an upper inner tube head assembly in the lowering position are showed, according to a fifth embodiment of disclosure.
Figure 23:
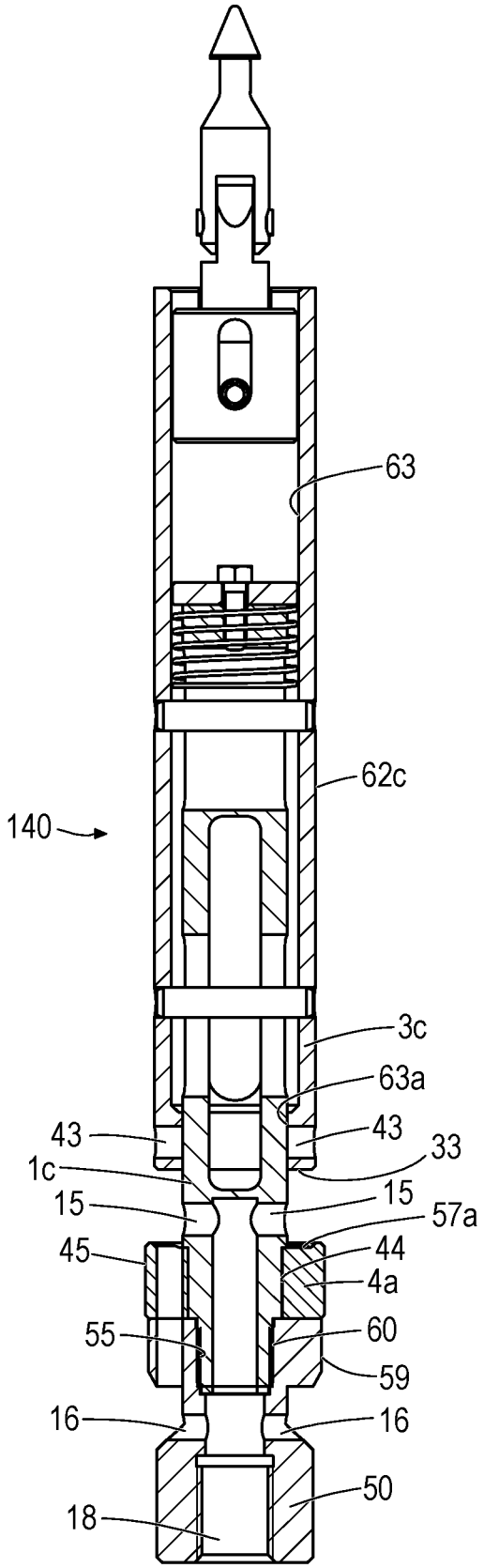
FIG. 23: Longitudinal section view through the cutline 23-23 of the upper inner tube head assembly in the lowering position, according to the fifth embodiment of the disclosure.
Figure 24A:
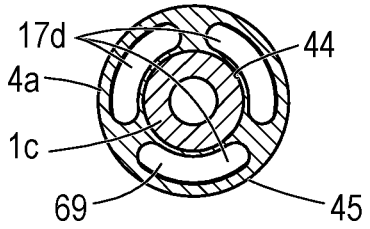
FIG. 24A: Cross-sectional view through cutline 24A-24A of the support component of the upper inner tube head assembly in the lowering position, according to the fifth embodiment of the disclosure.
Figure 25:
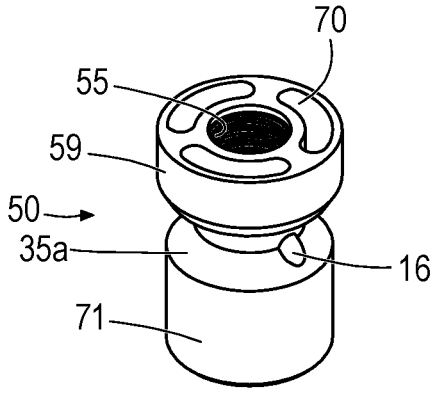
FIG. 25: Isometric view of the lower body of the upper inner tube head assembly, according to the fifth embodiment of the disclosure.
Figure 26:
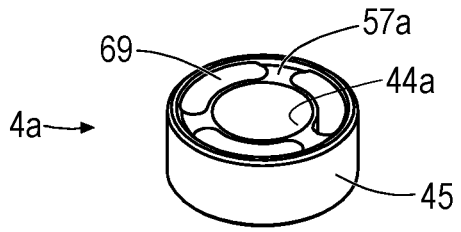
FIG. 26: Isometric view of the support component of the upper inner tube head assembly, according to the fifth embodiment of the disclosure.
Figure 27:
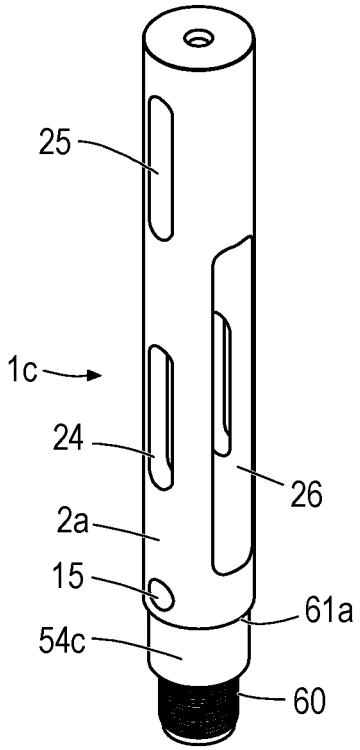
FIG. 27: Isometric view of the main body of the upper inner tube head assembly, according to the fifth embodiment of the disclosure.
Figure 28:
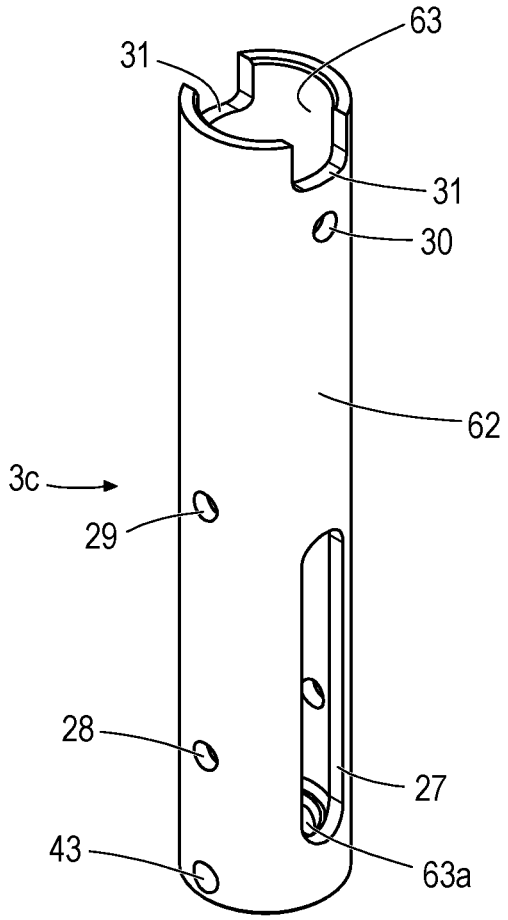
FIG. 28: Isometric view of the retractable body of the upper inner tube head assembly, according to the fifth embodiment of the disclosure.

FIGS. 22, 23 and 25 show the lower body 50 having at least one lower body fluid passage channel 70, such that it corresponds to a support component fluid passage channel 69 for forming a fluid passage area 17*d*, as seen in FIG. 24A. Said lower body 50 has an upper outer surface 59, a transition surface 35*a* and a lower outer surface 71. The lower body coupling area 55 allows to receive the coupling area 60 and then inside is a lower central chamber 14*b*, which in cooperation with an upper central chamber 14*a* communicate the inlet port 15 with the outlet port 16. The fluid flow through the rapid lowering area 17*d* will be restricted when the stop surface 33 contacts a support component seating surface 57*a* and the flow is forced to pass through the fluid bypass chamber 13. The rapid lowering area 17*d* is then defined by the sliding surface 2*a*, the support component 4*a* and the lower body 50 following the fluid a fluid passage path 22*d*.

Figure 24B:
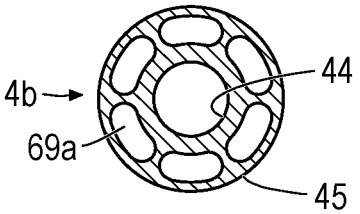
FIG. 24B: Cross-sectional view of a support component of an upper inner tube head assembly in the lowering position, according to a sixth embodiment of the disclosure.
Figure 24C:
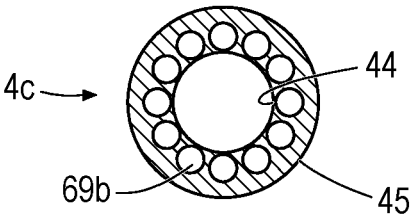
FIG. 24C: Cross-sectional view of a support component of an upper inner tube head assembly in the lowering position, according to a seventh embodiment of the disclosure.
Figure 24D:
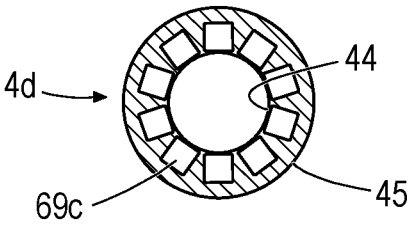
FIG. 24D: Cross-sectional view of a support component of an upper inner tube head assembly in the lowering position, according to an eighth embodiment of the disclosure.

It can be seen from FIG. 24A that the rapid lowering area 17*d* will be the contribution of each fluid passage channel of support component 69. The latter may have variations as seen in FIGS. 24B to 24D, where the support components 4*b*, 4*c* and 4*d* are shown respectively, with their corresponding inner surfaces of support component 44 and outer surfaces of support component 45, and where the fluid passage channels of support component 69*a*, 69*b* and 69*c* define the corresponding rapid lowering areas, making it evident that there may be other variants of the geometry of the fluid passage channel of the support component 69, with which it would be intended to improve the problems of lowering time of the inner tube assembly to its working position and that they will be susceptible to variation provided that this does not involve an alteration of the essential characteristics of the disclosure, so that they are part of the present disclosure, so any modification made should be considered.

The invention claimed is:

1. An upper inner tube head assembly that is coupled to a lower inner tube head assembly through a coupling area to form an axially movable inner tube assembly within a drilling pipe assembly of a system for the extraction of samples by means of a core barrel, comprising:

a main body on which a retractable body is slidably and concentrically mounted, a support component whose axial upward movement is restricted by a main body seat and downwardly by a rear component whose inner surface of rear component cooperates with an outer surface of the main body; and a means of fluid control to increase the fluid flow during movement of the inner tube assembly within a drilling pipe assembly, the means of fluid control comprising:

at least one closing/opening body having at least one valve component which is connected through a valve component connector to the retractable body, where the valve component moves on a sliding surface of the main body and sits on the support component when the inner tube assembly is lowered into a working position of the inner tube assembly and moves away from the inner tube assembly when the inner tube assembly moves away from the working position of the inner tube assembly, and a fluid bypass chamber arranged within the main body and communicating with the outer surface of the main body in at least two different positions along the chamber or at least one rapid lowering area formed between the sliding surface of the main body together with the inner surface of the support component and the rear component, said at least one rapid lowering area is a fluid passage channel for fluid flow externally to the main body, and formed to allow free flow of fluid along a fluid passage path during the lowering of the inner tube assembly.

2. The upper inner tube head assembly according to claim 1, wherein the main body additionally has a second rear component mounted on the support component, said support component being intermediate the rear component and the second rear component.

3. The upper inner tube head assembly according to claim 1, wherein the rear component has a threaded inner surface that mounts on a respective main body threaded outer surface portion, such that the support component is superimposed on a respective main body unthreaded surface portion.

4. The upper inner tube head assembly according to claim 1, wherein the fluid bypass chamber includes a central chamber, at least one inlet port and at least one outlet port, so that it achieves a fluid connection between the exterior of the main body, the fluid entering through the inlet port, passing through the central chamber and exiting through the outlet port, towards a drilling bit in the drilling pipe assembly.

5. The upper inner tube head assembly according to claim 4, wherein a respective support component fluid passage channel has a channel geometry that is selected from one of a group consisting of square, circular, and elongated curved, arranged symmetrically throughout the perimeter of the support component.

6. An upper inner tube head assembly that is coupled to a lower inner tube head assembly through a coupling to form an axially movable inner tube assembly within a drilling pipe assembly of a system for the extraction of samples by means of a core barrel, comprising:

a main body on which a retractable body is slidably and concentrically mounted, a support component whose axial movement upwards is restricted by a main body seat and downwards by a lower body that is connected to the main body through a coupling area that cooperates with a lower body coupling area, so that the movement of the support component is restricted;

wherein at least one rapid lowering area is formed on the inner surface of the support component and the main body, said at least one rapid lowering area corresponding to a respective support component fluid passage channel for fluid flow externally to the main body; and wherein the lower body has at least one lower body fluid passage channel corresponding to the at least one support component fluid passage channel.

7. The upper inner tube head assembly according to claim 6, wherein further a fluid bypass chamber formed by an upper central chamber of the main body that cooperates with a lower central chamber of the main body allows the fluid flow in a flow path through an inlet port arranged in the main body and an outlet port arranged in the main body.

8. The upper inner tube head assembly according to claim 6, wherein the respective support component fluid passage channel has a channel geometry that is selected from one of a group consisting of square, circular, and elongated curved shapes, arranged symmetrically around the entire perimeter of the support component.

9. A drilling pipe assembly for the extraction of a drilling core by means of a core barrel comprising:

an outer tube assembly including a locking coupling that connects to the drilling pipe assembly, an adapter coupler connected at its lower end to an outer tube that internally receives an arrival ring; and an inner tube assembly arranged within the outer tube assembly and including an upper inner tube head assembly as described in claim 1, a lower inner tube head assembly and an inner tube in which the sample or core sample is accommodated.

10. The drilling pipe assembly according to claim 9, wherein a reamer is arranged at the lower end of the outer tube allowing the hole previously drilled by the drilling bit to be enlarged.

* * * * *